United States Patent [19]

Verch

[11] 4,124,172

[45] Nov. 7, 1978

[54] SELF BRAKING PACKAGE FOR STRIP MATERIAL

[75] Inventor: John T. Verch, Hastings, Minn.

[73] Assignee: Minnesota Mining and Manufacturing Company, St. Paul, Minn.

[21] Appl. No.: 805,994

[22] Filed: Jun. 13, 1977

[51] Int. Cl.[2] ..... B65D 85/672; B65H 75/02; B65H 77/00

[52] U.S. Cl. ..... 242/55.53; 206/398; 206/409; 242/75.4

[58] Field of Search ..... 242/55.53, 75.4, 137.1, 242/138, 105, 99, 1; 206/398, 409; 225/51, 52, 46, 47, 48, 41

[56] References Cited

U.S. PATENT DOCUMENTS

| | | | |
|---|---|---|---|
| 772,943 | 10/1904 | Krauth | 242/55.53 |
| 943,279 | 12/1909 | Smith | 242/55.53 |
| 1,340,710 | 5/1920 | Graham | 242/75.4 |
| 2,237,920 | 4/1941 | Armitt | 242/55.53 |
| 2,579,844 | 12/1951 | Martin | 225/47 |
| 3,373,865 | 3/1968 | Hollins | 225/47 |

*Primary Examiner*—George F. Mautz
*Attorney, Agent, or Firm*—Cruzan Alexander; Donald M. Sell; William L. Huebsch

[57] ABSTRACT

A package for a roll of strip material such as linered or unlinered pressure sensitive adhesive tape. The package includes a protective housing around the roll of strip material, and brake members extending radially of the roll and bearing against circular facing sheets on the side surfaces of the roll to restrict its free rotation and cause a predetermined generally constant tension in the strip material being withdrawn from the roll.

9 Claims, 6 Drawing Figures

SELF BRAKING PACKAGE FOR STRIP MATERIAL

BACKGROUND OF THE INVENTION

This invention relates to packages containing rolls of strip material such as pressure sensitive adhesive tape which strip material is withdrawn from the package as it is used.

Machines which dispense lengths of strip material or apply lengths of strip material (such as pressure sensitive adhesive tape) to an object from a roll of the strip material typically include a mechanism adapted to engage and rotatably support a hub of the roll. Usually this mechanism includes a friction brake which limits rotation of the roll due to inertia after withdrawal of the strip material is terminated. Such a friction brake cannot be also used to provide a generally uniform tension in the strip material being withdrawn, however, since the tension it provides when the diameter of the roll is large would be substantially less than the tension it would provide when the roll is almost gone. Thus where such a generally uniform tension is desired typically a separate braking mechanism is provided along the path for the strip material adjacent the roll which provides such a predetermined generally constant tension independent of the diameter of the roll from which the strip material is withdrawn. These two mechanisms add cost and complexity to machines using rolls of strip material.

Additionally, large diameter rolls of some types of relatively narrow strip material (e.g. 14–15 inch diameter rolls of $\frac{3}{8}\frac{1}{2}$ inch wide pressure sensitive adhesive tape) present problems during shipment and while the strip material is being withdrawn from them since they telescope easily if their side surfaces are not adequately supported. This is particularly true where there is no adhesion between the coils in a roll, as when the strip material is a pressure sensitive adhesive tape with a liner over the adhesive coated surface of the tape. Also any adhesive exposed on the side surfaces of such rolls of tape will collect dirt which can adversely affect the appearance of the applied tape.

SUMMARY OF THE INVENTION

The present invention provides an inexpensive package for a roll of strip material which incorporates a brake that will limit inertial rotation of the roll and provide a generally constant, predetermined tension in the strip material being withdrawn; and will insure that the roll will not telescope or collect dirt during shipment or use.

The package according to the present invention includes a roll of strip material (which may be linered or unlinered pressure sensitive adhesive tape) spirally wound about a core, and a housing around the roll which rotatably supports the core and has an opening through which the strip material may be withdrawn from the roll. A circular facing sheet is disposed at each side surface of the roll, and the package includes opposed polymeric brake members flanking the facing sheets. Each brake member comprises a base portion mounted on the housing, an elongate pressure portion disposed radially of the roll and adapted to bear against the surface of the adjacent facing sheet opposite the roll, and a spring portion therebetween extending around the pressure portion. The spring portions press the pressure portions against the facing sheets to provide braking force for the roll of strip material therebetween, and produce a generally constant tension in the strip material being withdrawn which tension is not substantially affected by the change in diameter of the roll as the strip material is removed (e.g. a tension that will vary by less than about 25 percent of its initial value and not in proportion to the diameter of the roll). Applicant theorizes that this is because the force exerted by the braking members against the roll is generally constant, and the shape of the braking members applies this force primarily adjacent the periphery of the roll for any diameter of the roll between its maximum and minimum diameter so that the diameter of the roll has little effect on the tension caused in the strip material being withdrawn.

Additionally the force applied by the braking members insures that the roll of strip material will not telescope during shipment or use, and the sheets of material (the main function of which is to provide a barrier to insure that the braking members will not adhere to adhesive exposed on the side surfaces of the roll) cover the side surfaces of the roll to insure that dirt will not be collected thereon.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
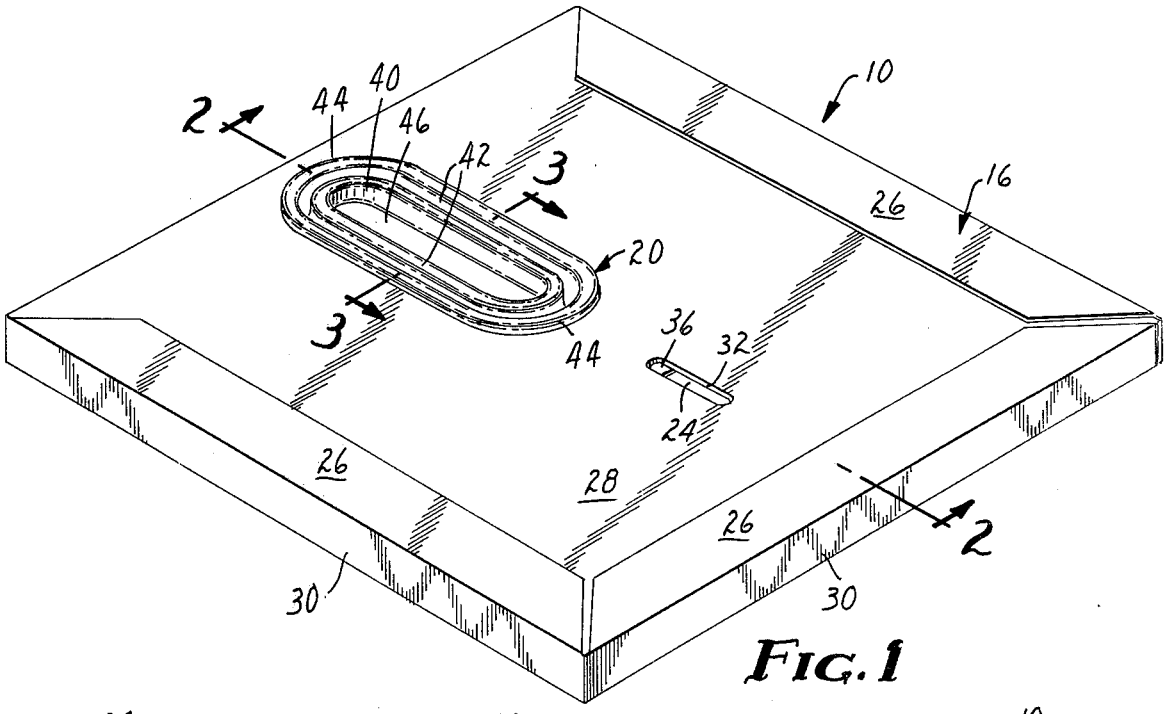
FIG. 1 is a perspective view of a package for strip material according to the present invention.

Referring now to the drawing, there is illustrated a package of strip material according to the present invention, generally designated by the numeral 10.

Figure 6:
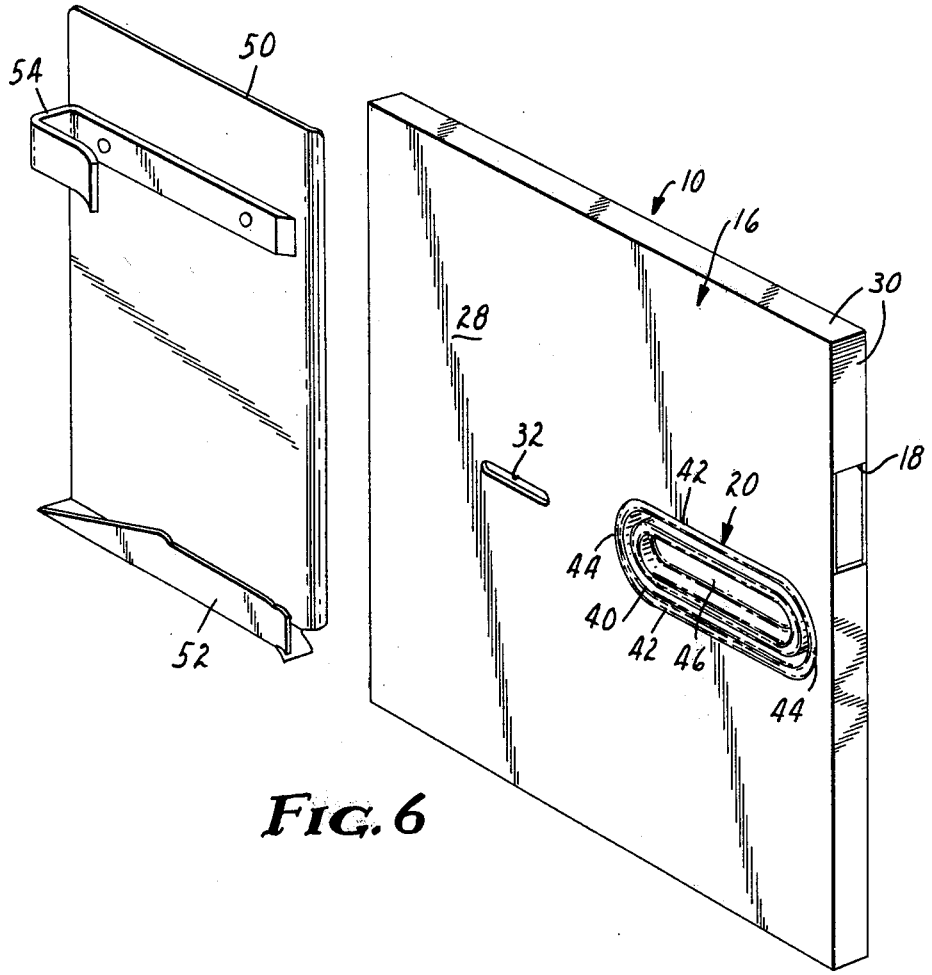
FIG. 6 is a perspective view of the package of FIG. 1 shown with a holder adapted to receive the package.

The package 10 comprises a roll 12 of strip material or pressure sensitive adhesive tape spirally wound on a core 14; and a housing 16 around the roll 12 supporting a hub 17 about which the core 14 is rotatably mounted and having an opening 18 (FIG. 6) through which tape may be withdrawn from the roll 12.

The package 10 also includes brake means for providing a generally constant tension in tape being withdrawn from the roll 12. The brake means includes opposed elongate brake members 20 disposed radially of the roll 12 and adapted to exert a force toward side surfaces 22 of the roll; and two circular stiff facing sheets 24 of polymeric material (e.g. 0.005 mm thick polypropylene) flanking the side surfaces 22 of the roll 12 against which facing sheets 24 the brake members 20 press. The facing sheets 24 prevent the brake members 20 from becoming adhered to adhesive exposed on the side surfaces 22 of the roll 12 and provide parallel smooth surfaces which will move at a steady rate between the brake members 20 as tape is withdrawn from the roll 12.

The housing 16 preferably is formed from a single piece of corrugated cardboard folded and adhesively joined via tabs 26 to provide two parallel side walls 28 over the outer surfaces of the facing sheets 24 and narrow edge walls 30 about the periphery of the side walls 28. A radially extending slot 32 may be formed in each of the side walls 28 to afford visual inspection of the amount of tape remaining on the roll 12.

Figure 2:
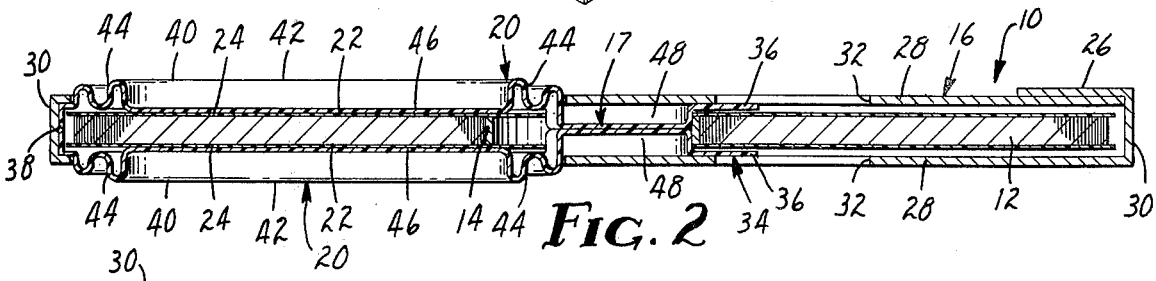
FIG. 2 is a sectional view taken approximately along line 2—2 of FIG. 1.
Figure 4:
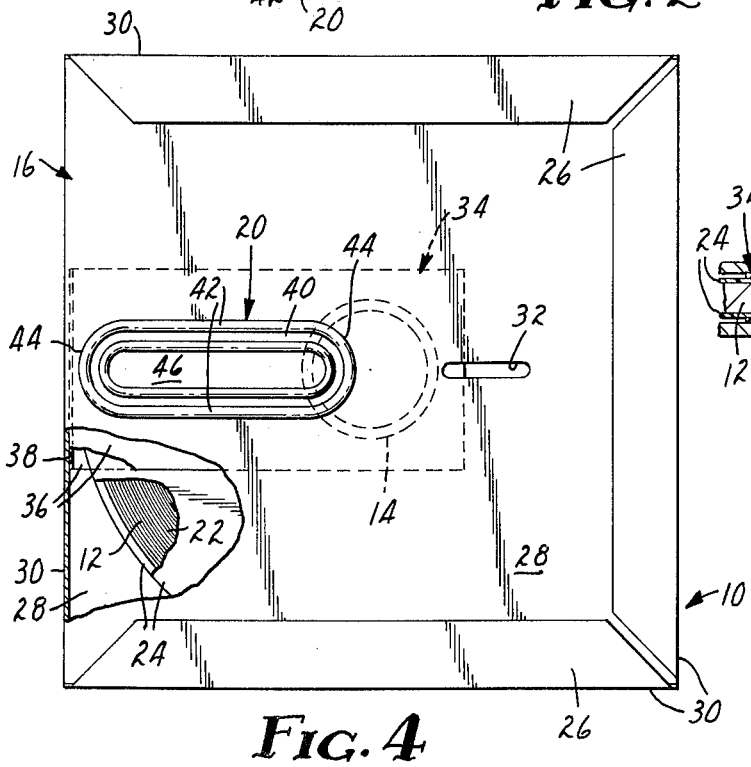
FIG. 4 is a plan view of the package of FIG. 1 having parts broken away to show details.
Figure 3:
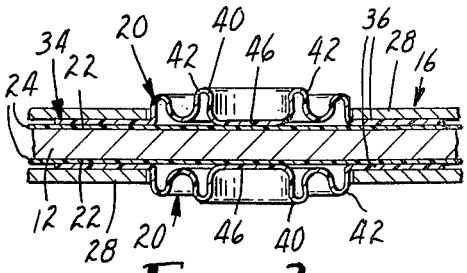
FIG. 3 is a fragmentary sectional view taken approximately along lines 3—3 of FIG. 1.
Figure 5:
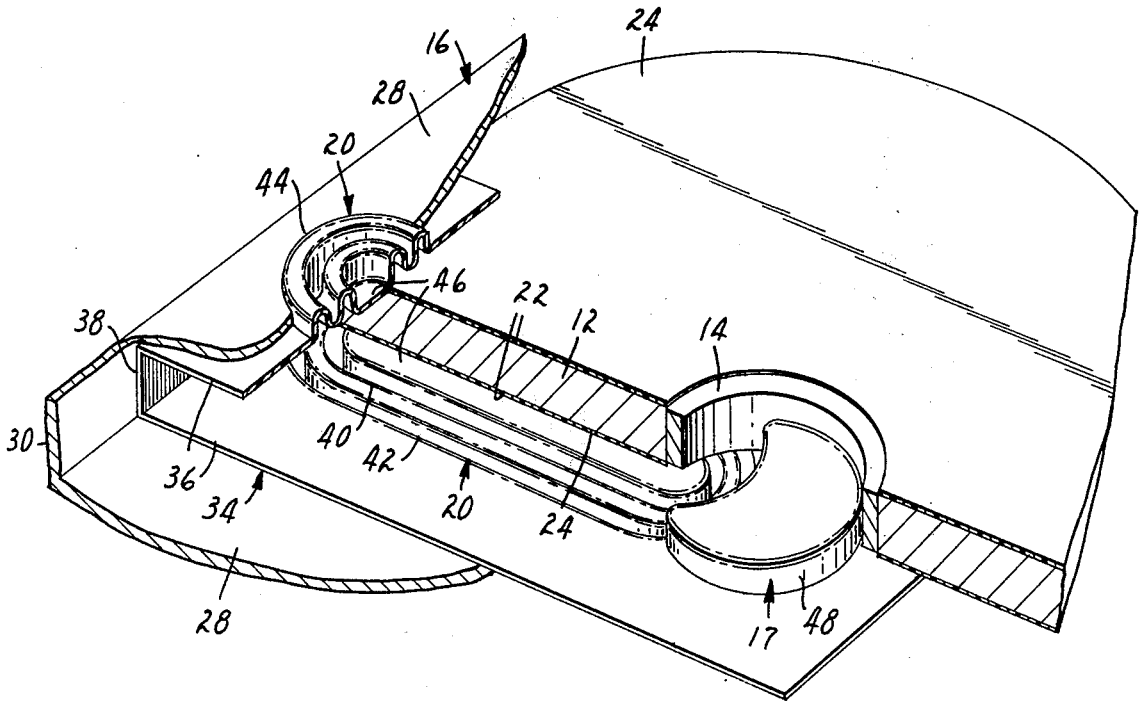
FIG. 5 is an enlarged fragmentary perspective view of the package of FIG. 1 having parts broken away to show details.

The brake members 20 are preferably formed as a unitary member 34 from a sheet of a stiff resiliently elastic polymeric material (e.g. from a 0.040 inch thick sheet of super high impact polystyrene) which has been folded into generally a U-shape to provide base portions 36 of the brake members 20 mounted by adhesive on the inner surfaces of the side walls 28, and an end portion 38 of member 34 joining the base portions 36 and bridging around the periphery of the roll of tape 12 (FIG. 5). The unitary member 34 has been vacuum formed to provide a spring portion 40 for each brake member 20 which is sinuous or generally W-shaped in cross section (see FIGS. 2 and 3), and is positioned in an opening in the side wall 28 to which it is adhered. Each spring portion 40 has straight sides 42 disposed parallel to and equidistant from a radius for the roll of tape 12, and has arcuate end portions 44 joining the sides 42 so that the spring portion 40 extends completely around an elongate generally planar elongate pressure portion 46 of the brake member 20 which bears against the adjacent facing sheet 24 and extends radially of the roll of tape 12 from its core 14 almost to its periphery (e.g. within about ½ inch of its periphery).

Additionally the unitary member 34 is vacuum formed to provide mating projections 48 with opposed planar surfaces joined as by sonic welding or an adhesive (FIGS. 2 and 5) and having aligned arcuate peripheral surfaces which are adapted to rotatably support the core 14 of the roll 12 so that the projections 48 provide the hub 17 about which the core 14 is journaled. The attachment of the projections 48 also properly spaces the ends of the brake members 20 adjacent the core 14 of the roll 12 and with the end portion 38 of the member 34 (which spaces the ends of the brake members 20 at the periphery of the roll 12) provides a needed rigidity and alignment for the brake members 20 so that a braking force will be accurately applied via the spring portions 40.

The tape package may be easily mounted on a machine through which the tape is to be dispensed by sliding the package into a holder 50 of the type illustrated in FIG. 5 including a flange 52 for engaging and supporting one of its edge walls, and a hook-like member 54 engaging and holding an upper portion of the package 10. The package 10 is rotated 180° about its vertical axis from the position illustrated in FIG. 5 before it is inserted into the holder so that the hook-like member 54 will engage the package 10 adjacent the opening 18.

EXAMPLE

The following is an example of a tape package according to the present invention which is adapted for use with a roll of ½ inch wide #898 Filament Tape as manufactured by Minnesota Mining and Manufacturing Company, which roll has an initial diameter of 14½ inches and is wound on a three inch core. The housing 16 is formed of ⅛ inch thick corrugated cardboard. The unitary member 34 is formed of a 0.040 inch thick sheet of super high impact polystyrene to provide pressure portions 46 having a width of about ¾ inch and a length of about 5⅜ inch and having fully radiused ends. The spring portions 40 extend about ⅞ inch beyond the edges of the pressure portions 40 in the plane of the side walls 28, and project about ¼ inch above the base portions 36 away and normal to the side surfaces 22 of the roll 12. The adjacent surfaces of the pressure portions 46 are spaced at about ¼ inch when unloaded, and the facing sheets 24 are of 0.005 inch thick polypropylene so that each of the spring portions is deflected about ⅛ inch when the roll 12 and sheets 24 are therebetween. Tests have shown that this configuration provides a tension in the range of about 6 to 7½ pounds in tape being withdrawn from the roll 12 between the time that the roll is full and when the roll has only a diameter of about 3⅛ inch (without the braking members 20 this tension would be about 1½ pounds), after which the tension may increase to about 11 pounds which is believed due more to the adhesion of the inner wraps of tape to each other than to the friction applied by the brake members 20. Rolls of such tape contained in packages of this type of tape show no tendency to telescope either when stored on their sides or when tape is being withdrawn from them by a machine.

I claim:

1. A package comprising:

a roll of tape spirally wound about a core;

a housing around said roll including a hub about which said core is rotatably supported and having an opening through which tape from said roll may be withdrawn;

a facing sheet on each side surface of said roll of tape; and opposed elongate brake members disposed radially of said roll, each brake member comprising a base portion mounted on said housing, a pressure portion adapted to bear against one of said facing sheets and a spring portion between said base portion and said pressure portion having straight parallel sides disposed parallel to and equidistant from a radius for said roll of tape, and arcuate ends joining said sides, said spring portions being adapted to press said pressure portion against said sheets to provide generally a uniform tension in tape being withdrawn from the roll independent of the diameter of the roll.

2. A package according to claim 1, wherein each of said spring portions is sinuous in cross section between said base portion and said pressure portion.

3. A package according to claim 1, wherein said brake members further include projecting portions attached together through said core to provide said hub for rotatably supporting said roll of tape.

4. A package according to claim 1, wherein said tape is pressure sensitive adhesive tape.

5. A package comprising:

a roll of tape spirally wound about a core;

a housing around said roll including a hub about which said core is rotatably supported and having an opening through which tape from said roll may be withdrawn;

a facing sheet on each side surface of said roll of tape; and opposed elongate brake members disposed radially of said roll, each brake member comprising a base portion mounted on said housing, a pressure portion adapted to bear against one of said facing sheets and a spring portion between said base portion and said pressure portion, said spring portions being adapted to press said pressure portions against said sheets to provide generally a uniform tension in tape being withdrawn from the roll independent of the diameter of the roll, both of said brake members being formed as a unitary polymeric member, said unitary polymeric member being folded into generally a U-shape to provide said base portions and an end portion joining adjacent ends of said brake members and bridging around the periphery of said roll of tape, and said unitary polymeric member including opposed projecting portions adjacent the end of said brake members opposite said end portion which projecting portions are attached together through said core to provide said hub for rotatably supporting said roll of tape.

6. A package according to claim 5, wherein each of said spring portions is sinuous in cross section between the associated base portion and pressure portion, and has straight sides disposed parallel to and equidistant from a radius for said roll of tape and arcuate ends joining said sides to completely surround said associated pressure portion.

7. A package comprising:

a roll of strip material spirally wound about a core;

a facing sheet on each side surface of said roll of strip material; and a unitary member formed from a sheet of polymeric material and folded into generally a U-shaped to provide opposed base portions flanking said facing sheets, an end portion bridging around the periphery of said roll, opposed projecting portions attached together through said core to provide a hub about which said roll is rotatably journaled, opposed elongate pressure portions disposed radially of said roll bearing against said facing sheets, and a spring portion entirely around each of said pressure portions and between said pressure portion and said base portion adapted to press said pressure portions against said sheets to provide generally a uniform tension in strip material being withdrawn from the roll independent of the diameter of the roll.

8. A package according to claim 7, wherein said spring portion is generally W-shaped in cross section.

9. A package according to claim 7, wherein said strip material is pressure sensitive adhesive tape.

* * * * *